US008297437B2

(12) United States Patent
Smalley et al.

(10) Patent No.: US 8,297,437 B2
(45) Date of Patent: Oct. 30, 2012

(54) CARRIER FOR CONTAINERS

(75) Inventors: Brian Smalley, Downend (GB); Paul Bradford, Staple Hill (GB)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 13/193,719

(22) Filed: Jul. 29, 2011

(65) Prior Publication Data

US 2012/0000913 A1 Jan. 5, 2012

Related U.S. Application Data

(63) Continuation of application No. PCT/US2010/025494, filed on Feb. 26, 2010.

(60) Provisional application No. 61/208,870, filed on Feb. 27, 2009.

(51) Int. Cl.
*B65D 5/462* (2006.01)
*B65D 5/481* (2006.01)
*B65D 5/00* (2006.01)

(52) U.S. Cl. ..... 206/170; 206/193; 206/162; 206/171; 206/188

(58) Field of Classification Search ..... 206/170, 206/188, 171, 172, 175, 174, 180, 187, 193, 206/427, 198, 162, 173; 229/117.14; 493/88, 493/162; 220/557, 553
See application file for complete search history.

(56) References Cited

U.S. PATENT DOCUMENTS 2,222,211 A 11/1940 Arneson
(Continued)

FOREIGN PATENT DOCUMENTS

| | | | |
|---|---|---|---|
| DE | 90 04 439 | U1 | 6/1990 |
| EP | 1 319 607 | A1 | 6/2003 |
| EP | 2 102 073 | B1 | 9/2010 |
| FR | 2 825 074 | A1 | 11/2002 |
| GB | 926874 | | 5/1963 |
| WO | WO 97/05026 | A1 | 2/1997 |
| WO | WO 99/01356 | | 1/1999 |
| WO | WO 2006/020525 | | 2/2006 |
| WO | WO 2008/089124 | | 7/2008 |

OTHER PUBLICATIONS

International Search Report and Written Opinion dated Oct. 11, 2010 for PCT/US2010/025494.

*Primary Examiner* — Steven A. Reynolds
(74) *Attorney, Agent, or Firm* — Womble Carlyle Sandridge & Rice, LLP

(57) ABSTRACT

A carrier for holding a plurality of containers. The carrier comprises at least one bottom panel, a front panel, a back panel, and at least two side panels. The interior of the carrier is divided into a front portion and a back portion by a first and second central panel. A first divider flap is foldably attached to the first central panel and extends to the front panel to divide the front portion into at least two container-receiving spaces. A second divider flap is foldably attached to the second central panel and extends to the back panel to divide the back portion into at least two container-receiving spaces. The first central panel has features for facilitating positioning of the second divider flap relative to the second central panel. The second central panel has features for facilitating positioning of the first divider flap relative to the first central panel.

32 Claims, 12 Drawing Sheets

U.S. PATENT DOCUMENTS 2,225,822 A 12/1940 Crook
2,227,330 A 12/1940 Turner
2,331,312 A 10/1943 Dorfman
2,336,857 A 12/1943 Gies et al.
2,457,308 A 12/1948 Hall et al.
2,460,108 A 1/1949 Smith et al.
2,660,361 A 11/1953 Tyrseck
2,689,061 A 9/1954 Gray
2,721,001 A 10/1955 Hasselhoff
2,772,020 A 11/1956 Kramer
2,776,072 A 1/1957 Forrer
2,783,916 A 3/1957 Hodapp
2,991,908 A 7/1961 Conescu
3,029,977 A 4/1962 Arneson
3,053,411 A 9/1962 Struble et al.
3,128,906 A 4/1964 Forrer
3,190,487 A 6/1965 Wood
3,191,800 A 6/1965 Kowal
3,194,478 A 7/1965 Weiss
3,229,849 A 1/1966 Spillson
3,236,414 A 2/1966 Slevin, Jr.
3,313,466 A 4/1967 Keith
3,343,742 A 9/1967 Siegler
3,352,452 A 11/1967 Graser
3,432,073 A 3/1969 Forrer
3,554,401 A 1/1971 Wood
3,624,790 A 11/1971 Stout
3,661,297 A 5/1972 Wood
3,669,306 A 6/1972 Forrer
3,672,539 A 6/1972 Forrer
3,709,400 A * 1/1973 Arneson ..... 206/187
3,721,335 A 3/1973 Grant
3,722,738 A * 3/1973 Wright ..... 206/187
3,754,680 A 8/1973 Wood
3,784,053 A 1/1974 Stout
3,860,113 A 1/1975 Helms
3,893,565 A 7/1975 Rossi et al.
3,917,059 A 11/1975 Wood
3,917,060 A 11/1975 Wood
3,917,061 A 11/1975 Stout
4,000,813 A 1/1977 Stout
4,010,847 A 3/1977 Wood et al.
4,153,158 A 5/1979 Graser et al.
4,171,046 A 10/1979 Bonczyk
4,187,944 A * 2/1980 Wood ..... 206/187
4,205,748 A 6/1980 Wilson
4,217,983 A 8/1980 Stout
4,243,138 A 1/1981 Wilson
4,250,992 A 2/1981 Gilbert
4,253,564 A 3/1981 Engdahl, Jr.
4,308,950 A 1/1982 Wood
4,318,470 A 3/1982 Montealegre
4,319,682 A 3/1982 Wright et al.
4,362,240 A 12/1982 Elward
4,374,561 A 2/1983 Stout et al.
4,377,252 A 3/1983 Schillinger
4,406,365 A 9/1983 Kulig
4,413,729 A 11/1983 Wood
4,450,956 A 5/1984 Wood
4,469,222 A * 9/1984 Graser ..... 206/180
4,480,746 A 11/1984 Wood
4,482,055 A 11/1984 Boyle
4,509,640 A 4/1985 Joyce
4,544,092 A 10/1985 Palmer
4,591,090 A 5/1986 Collins et al.
4,610,349 A 9/1986 Schwartz et al.
4,722,437 A 2/1988 Walsh
4,770,294 A 9/1988 Graser
4,782,943 A 11/1988 Blackman
4,782,944 A 11/1988 Engdahl, Jr.
4,792,038 A 12/1988 Cooper
4,927,009 A 5/1990 Stout
5,029,698 A 7/1991 Stout
5,040,672 A 8/1991 DeMaio et al.
5,072,876 A 12/1991 Wilson
5,123,588 A 6/1992 Harris
5,161,732 A 11/1992 Clein et al.
5,167,325 A 12/1992 Sykora
5,191,976 A 3/1993 Stout et al.
5,234,103 A 8/1993 Schuster
5,246,113 A 9/1993 Schuster
5,282,348 A 2/1994 Dampier et al.
5,359,830 A 11/1994 Olson et al.
5,363,954 A 11/1994 Dampier et al.
5,400,901 A 3/1995 Harrelson
5,458,234 A 10/1995 Harris
5,482,203 A 1/1996 Stout
5,484,053 A 1/1996 Harris
5,499,712 A 3/1996 Harrelson
5,518,110 A 5/1996 Harrelson
5,531,319 A 7/1996 Harrelson
5,538,130 A 7/1996 Harrelson
5,538,131 A 7/1996 Harrelson
5,547,074 A 8/1996 Plaxico et al.
5,579,625 A 12/1996 Olson et al.
5,590,762 A 1/1997 Harrelson
5,593,027 A 1/1997 Sutherland
5,611,425 A 3/1997 Holley, Jr.
5,620,094 A 4/1997 Naumann
5,638,956 A 6/1997 Sutherland
5,645,162 A 7/1997 Harrelson
5,649,620 A 7/1997 Harrelson
5,657,864 A 8/1997 Harrelson
5,657,865 A 8/1997 Harrelson
5,680,930 A 10/1997 Stone
5,682,982 A 11/1997 Stonehouse
5,695,051 A 12/1997 Hart
5,709,298 A 1/1998 Harris
5,765,685 A 6/1998 Roosa
5,775,487 A 7/1998 Harrelson
5,819,920 A 10/1998 Sutherland
5,855,316 A 1/1999 Spivey
5,871,090 A 2/1999 Doucette et al.
5,878,877 A 3/1999 Sutherland
5,884,756 A 3/1999 Holley, Jr. et al.
5,941,377 A 8/1999 Hart et al.
5,947,273 A 9/1999 Dalrymple et al.
6,003,665 A 12/1999 Stout
6,041,920 A 3/2000 Hart et al.
6,112,977 A 9/2000 Sutherland et al.
6,131,729 A 10/2000 Eckermann et al.
6,155,962 A 12/2000 Dalrymple et al.
6,168,013 B1 1/2001 Gomes
6,230,881 B1 5/2001 Collura
6,247,585 B1 6/2001 Holley, Jr.
6,315,111 B1 11/2001 Sutherland
6,321,906 B1 11/2001 Wein
6,341,689 B1 1/2002 Jones
6,371,287 B1 4/2002 Jones et al.
6,571,941 B2 6/2003 Holley, Jr.
6,695,137 B2 2/2004 Jones et al.
6,736,260 B2 5/2004 Gomes et al.
6,802,802 B2 10/2004 Woog
6,814,228 B2 11/2004 Sutherland
6,938,756 B2 9/2005 Schuster
7,011,209 B2 3/2006 Sutherland et al.
7,025,197 B2 4/2006 Sutherland
7,070,045 B2 7/2006 Theelen
7,128,206 B2 10/2006 Kohler
7,207,934 B2 4/2007 Schuster
7,374,038 B2 5/2008 Smalley
7,448,492 B2 11/2008 Sutherland
7,472,791 B2 1/2009 Spivey, Sr.
7,552,820 B2 6/2009 Kohler
7,604,116 B2 10/2009 Schuster
7,644,817 B2 1/2010 Sutherland
7,677,387 B2 3/2010 Brand et al.
7,762,395 B2 7/2010 Sutherland et al.
7,762,397 B2 7/2010 Coltri-Johnson et al.
7,793,780 B2 9/2010 Smalley
8,020,695 B2 9/2011 Brand
2002/0077236 A1 6/2002 Chalendar et al.
2002/0117407 A1 8/2002 Holley
2003/0111363 A1 6/2003 Theelen
2003/0159950 A1 8/2003 Jones et al.
2003/0213705 A1 11/2003 Woog
2004/0026269 A1 2/2004 Cuomo 2004/0050722 A1 3/2004 Schuster
2004/0094435 A1 5/2004 Auclair et al.
2005/0211577 A1 9/2005 Bakx
2005/0218014 A1 10/2005 Schuster
2005/0230273 A1 10/2005 Kohler
2006/0091024 A1 5/2006 Cuomo
2006/0148629 A1 7/2006 Cuomo
2006/0157545 A1 7/2006 Auclair
2007/0000980 A1 1/2007 Oliveira
2007/0017839 A1 1/2007 Sutherland
2007/0029212 A1 2/2007 Smalley
2007/0151873 A1 7/2007 Schuster
2008/0210581 A1 9/2008 Brand
2009/0008273 A1 1/2009 Smalley
2010/0006458 A1 1/2010 Wilkins et al.
2010/0072086 A1 3/2010 Smalley

* cited by examiner

CARRIER FOR CONTAINERS

CROSS-REFERENCE TO RELATED APPLICATIONS

This application is a continuation application of prior PCT Application No. PCT/US2010/025494, filed Feb. 26, 2010, entitled "Carrier for Containers," which PCT application claims the benefit of U.S. Provisional Application No. 61/208,870, filed Feb. 27, 2009.

INCORPORATION BY REFERENCE

The entire disclosures of PCT Application No. PCT/US2010/025494, filed Feb. 26, 2010, and U.S. Provisional Application No. 61/208,870, filed Feb. 27, 2009, are hereby incorporated by reference for all purposes as if presented herein in their entireties.

BACKGROUND OF THE DISCLOSURE

The present disclosure generally relates to carriers or cartons for holding and displaying containers. More specifically, the present disclosure relates to basket-style carriers.

SUMMARY OF THE DISCLOSURE

In general, one aspect of the disclosure is directed to a carrier for holding a plurality of containers. The carrier comprises a plurality of panels that extend at least partially around an interior of the carrier. The panels comprise at least one bottom panel, a front panel, a back panel, and at least two side panels. The interior of the carrier is divided into a front portion and a back portion by a first and second central panel. A first divider flap is foldably attached to the first central panel and extends to the front panel to divide the front portion into at least two container-receiving spaces. A second divider flap is foldably attached to the second central panel and extends to the back panel to divide the back portion into at least two container-receiving spaces. The first central panel has features for facilitating positioning of the second divider flap relative to the second central panel. The second central panel has features for facilitating positioning of the first divider flap relative to the first central panel.

In another aspect, the disclosure is generally directed to a blank for forming a carrier for holding a plurality of containers. The blank comprises a plurality of panels comprising at least one bottom panel, a front panel, a back panel, and at least two side panels. The blank further comprises a first central panel and a second central panel for dividing an interior of the carrier formed from the blank into a front portion and a back portion. A first divider flap is foldably attached to the first central panel, and a second divider flap is foldably attached to the second central panel. The first central panel has features for facilitating positioning of the second divider flap relative to the second central panel. The second central panel has features for facilitating positioning of the first divider flap relative to the first central panel.

In another aspect, the disclosure is generally directed to a method of forming a carrier for containing a plurality of containers. The method comprises obtaining a blank comprising a plurality of panels comprising at least one bottom panel, a front panel, a back panel, and at least two side panels, a first central panel, a second central panel, a first divider flap foldably attached to the first central panel, a second divider flap foldably attached to the second central panel. The first central panel has features for facilitating positioning of the second divider flap relative to the second central panel, and the second central panel has features for facilitating positioning of the first divider flap relative to the first central panel. The method further comprises folding the first and second central panels to be at least partially in face-to-face contact with at least a portion of the respective front and back panels, and folding the blank along a longitudinal centerline so that the first central panel is at least partially in face-to-face contact with the second central panel. The method further comprises forming an interior of the carrier by extending the at least two side panels away from the respective first and second central panels so that the interior of the carrier is divided into a front portion and a back portion by the first and second central panels. The method further comprises pivoting each of the first and second divider flaps away from the respective first and second central panels so that each of the first and second divider flaps extends to a respective one of the front and back panels.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENT

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

Carriers according to the present disclosure can accommodate containers of numerous different shapes. For the purpose of illustration and not for the purpose of limiting the scope of the disclosure, the following detailed description describes beverage containers (e.g., glass bottles or plastic containers) at least partially disposed within the carrier embodiments. In this specification, the terms "lower," "bottom," "upper", "top", "front", and "back" indicate orientations determined in relation to fully erected carriers.

Figure 1:
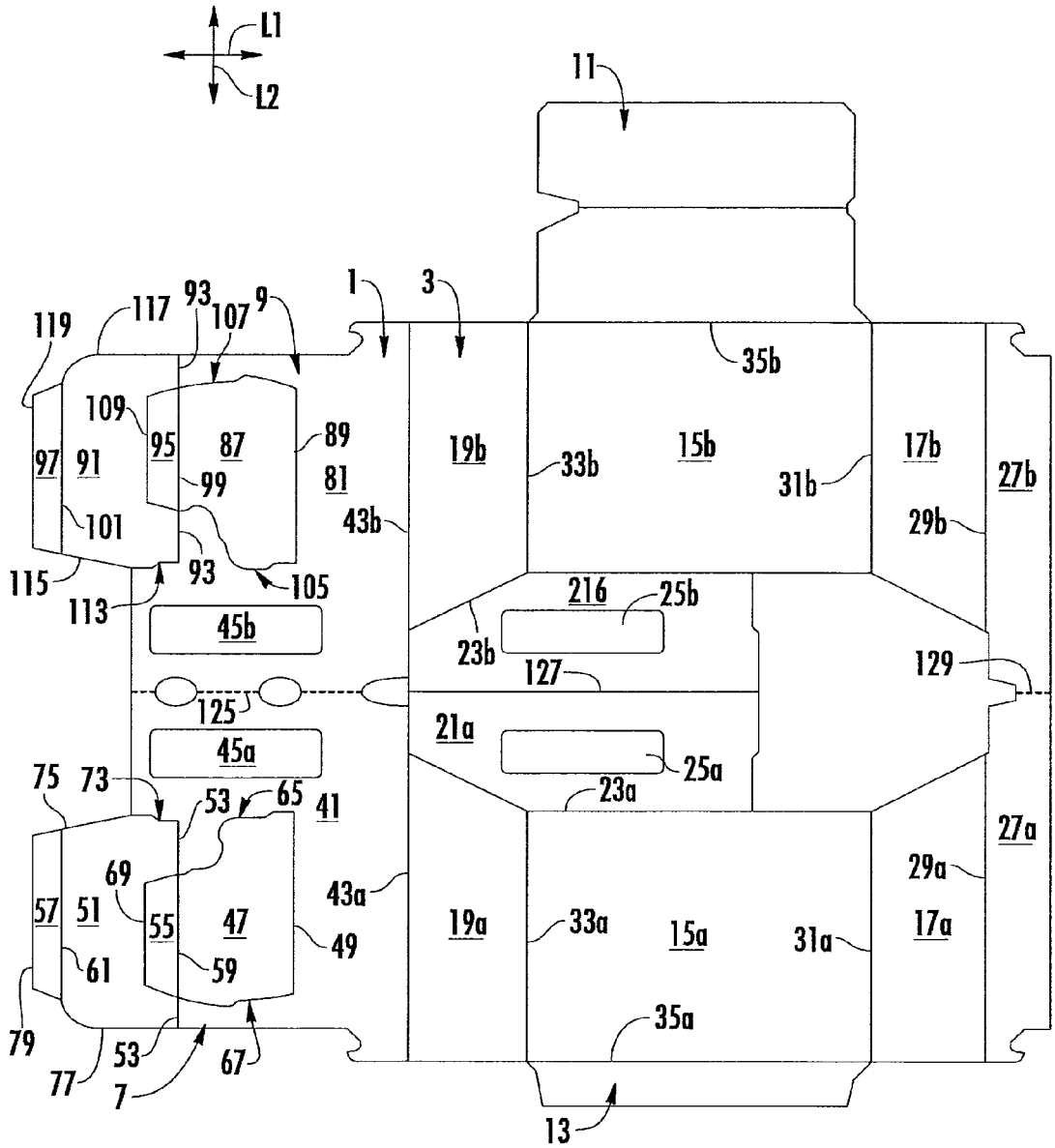
FIG. 1 is a plan view of an exterior of a carton blank used to form an exemplary basket-style carrier according to one embodiment of the disclosure.
Figure 7:
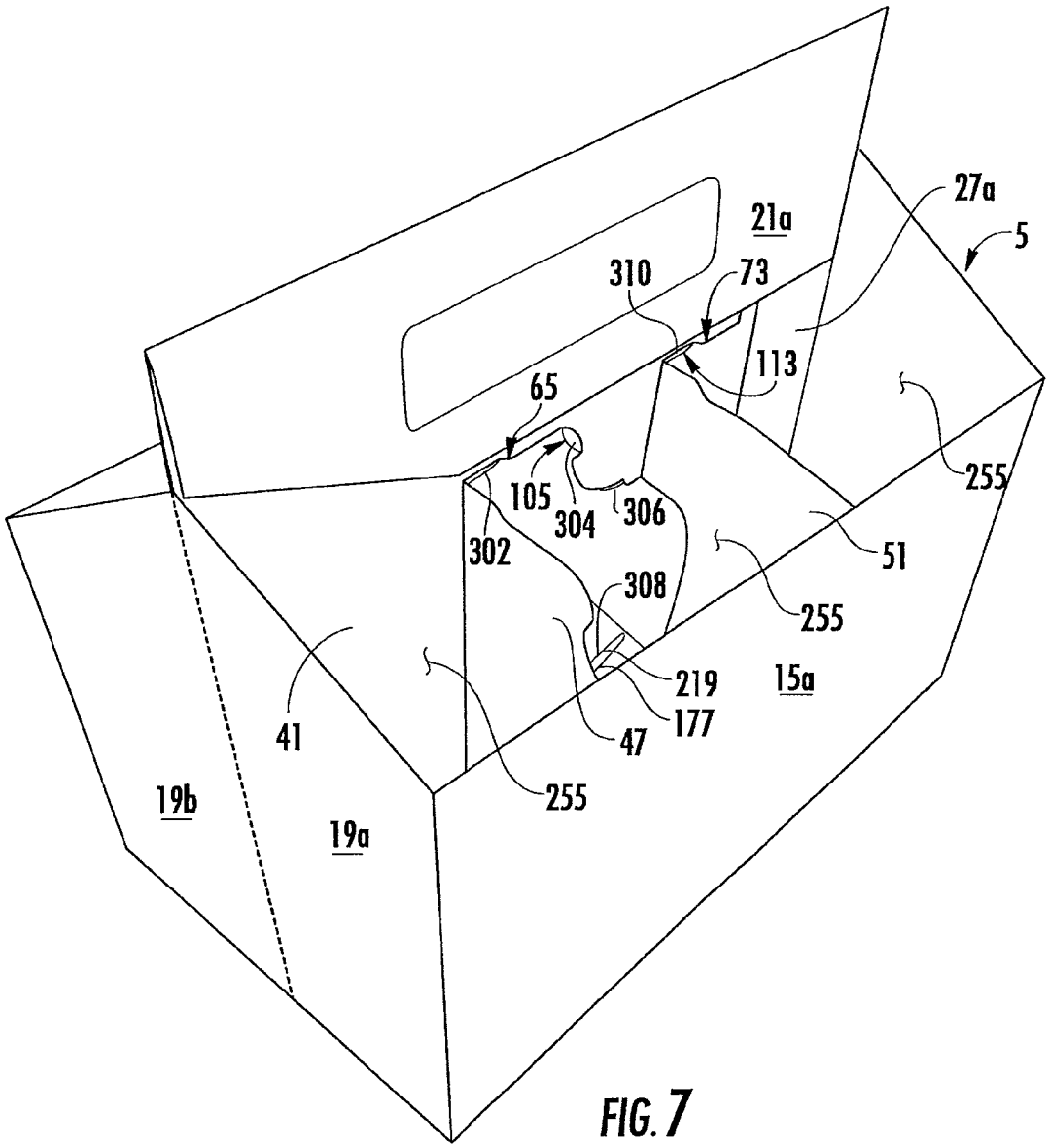
FIG. 7 is a perspective view of the exemplary basket-style carrier according to one embodiment of the disclosure.
Figure 8:
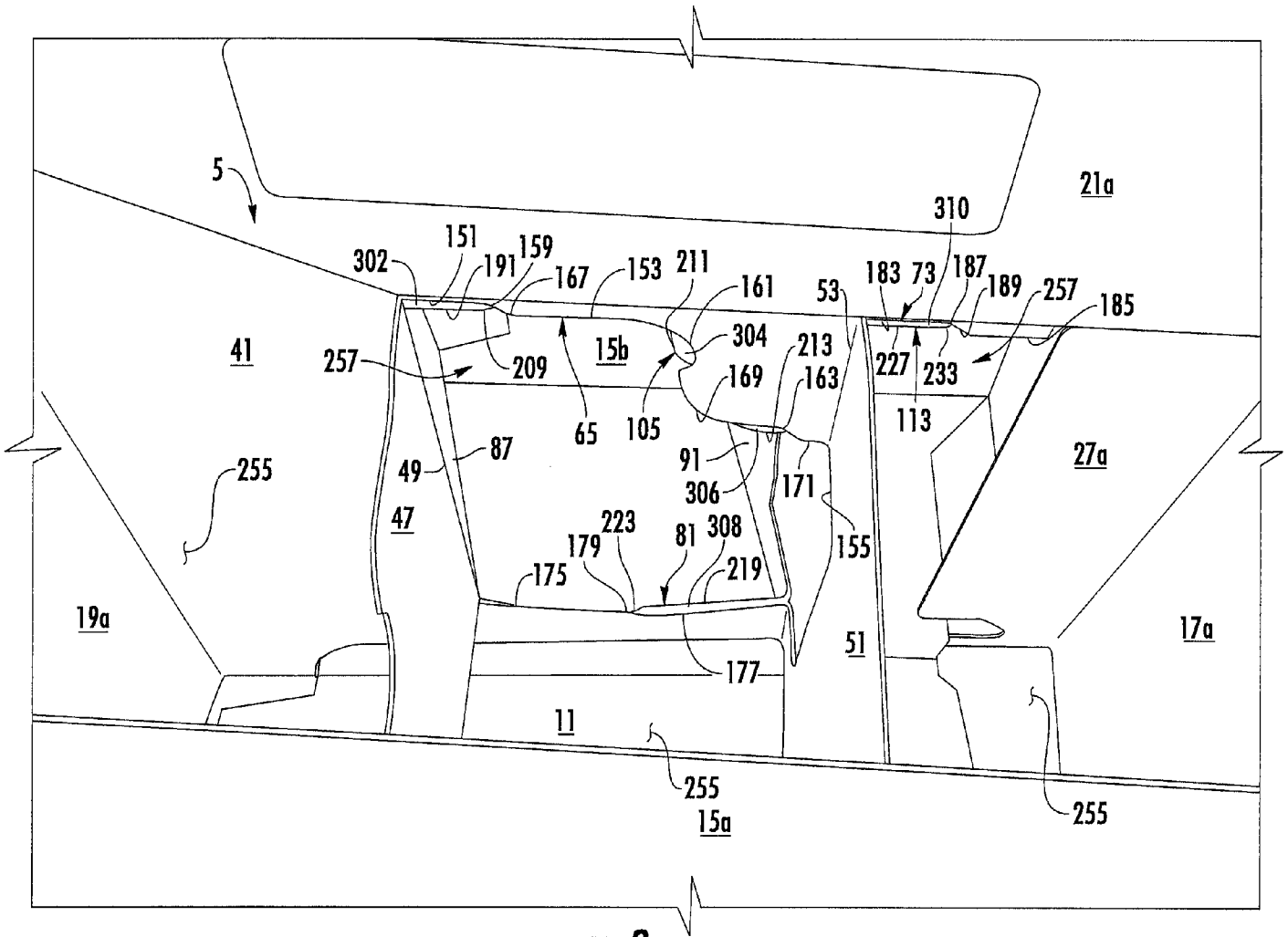
FIG. 8 is a perspective view of the front portion of the carrier of FIG. 7.
Figure 9:
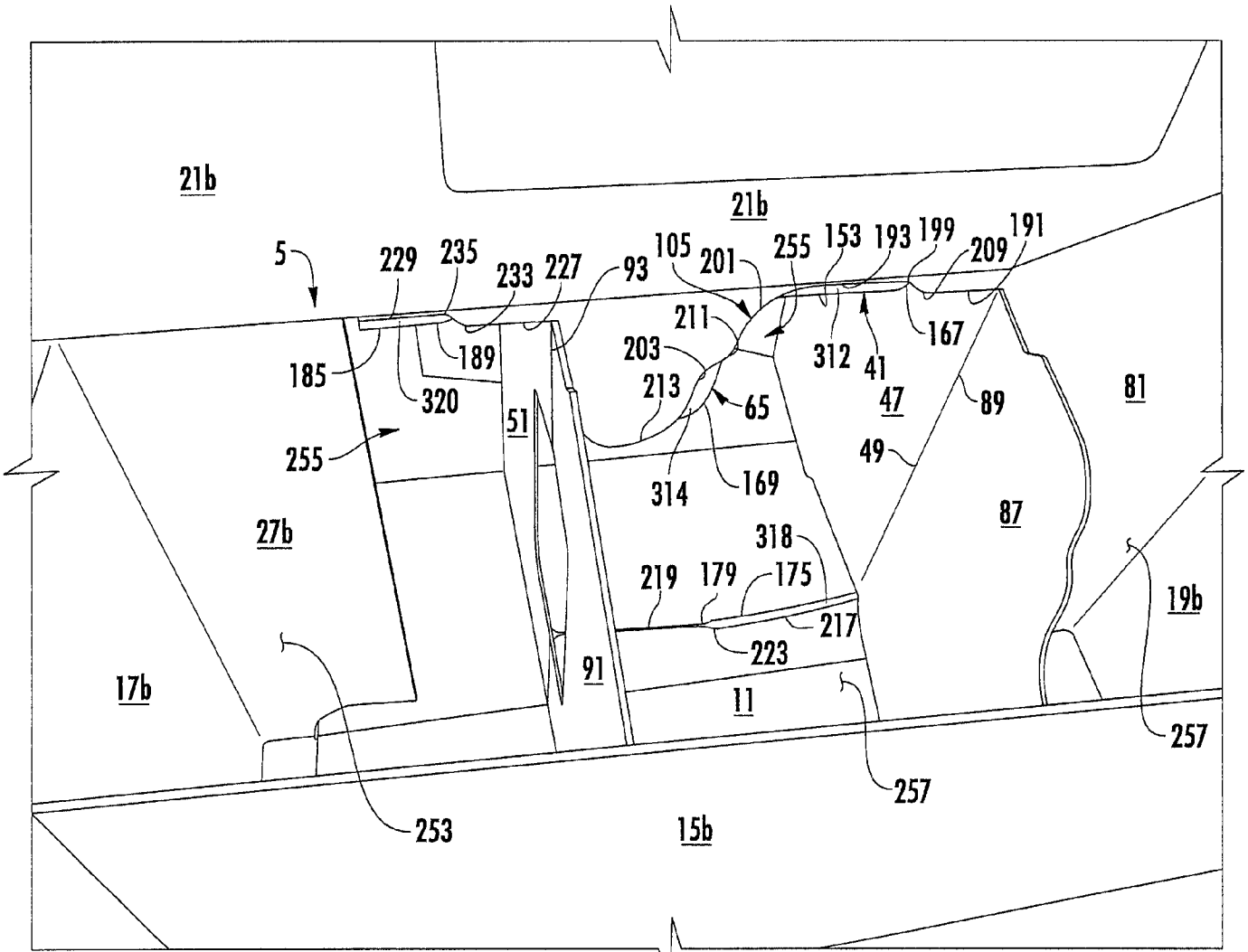
FIG. 9 a perspective view of the back portion of the carrier of FIG. 7.

FIG. 1 is a plan view of an exterior side 1 of a blank 3 used to form a package or basket-style carrier 5 (FIG. 7), in accordance with an exemplary embodiment of the present disclosure. As shown in FIGS. 7-9, the carrier 5 is sized to contain six containers (not shown), three containers being contained in a front portion of the carrier (FIG. 8) and three containers being contained in a back portion of the carrier (FIG. 9). The carrier may be sized and shaped to hold more or less than six containers.

The blank 3 has a longitudinal axis L1 and a lateral axis L2. The blank 3 has a front portion 7, a back portion 9, a bottom panel 11 foldably connected to the back portion, and a bottom adhesive flap 13 foldably connected to the front portion. In the illustrated embodiment, the front portion 7 and back portion 9 are for being folded about a longitudinal centerline CL (FIG. 2) when the blank 3 is formed into the carrier 5. As discussed in more detail below, the blank 3 is formed into the carrier 5 by folding the blank about the centerline CL so that the front portion 7 and the back portion 9 are overlapped.

In the illustrated embodiment, the front portion 7, comprises a front panel 15*a* foldably connected to a first side panel 17*a* and a second side panel 19*a*. The front portion 7 includes a front handle panel 21*a* adjacent the front panel 15*a* and second side panel 19*a*. The front handle panel 21*a* is separated from the front panel 15*a* and the second side panel 19*a* by a cut 23*a*. The front handle panel 21*a* includes a handle flap 25*a* foldably connected to the front handle panel. A central panel flap 27*a* is foldably connected to the first side panel 17*a* at a lateral fold line 29*a*. Lateral fold lines 31*a*, 33*a*, foldably connect a respective first and second side panel 17*a*, 19*a* to the front panel 15*a*. A longitudinal fold line 35*a* connects the bottom panel adhesive flap 13 to the front panel 15*a*.

In the illustrated embodiment, the features of the back portion 9 of the blank 3 include a back panel 15*b*, first side panel 17*b*, second side panel 19*b*, back handle panel 21*b*, and central panel flap 27*b* that are generally a mirror-image of the corresponding panel or flap of the front portion 7. Corresponding components (e.g., panels, flaps, fold lines, cuts, etc.) have been designated by corresponding reference numbers that differ by the "a" or "b" suffix, with the "a" components corresponding to the front portion 7 and the "b" components corresponding to the back portion 9 of the blank 3.

In one embodiment, the front portion 7 includes a front central panel 41 foldably connected to the second side panel 19*a* at a lateral fold line 43*a*. The central panel 41 includes a handle opening 45*a*. A first divider flap 47 is foldably connected to the front central panel 41 at a lateral fold line 49. A second divider flap 51 is foldably connected to the front central panel 41 at a lateral fold line 53. Each divider flap 47, 51 includes a respective adhesive flap 55, 57 foldably connected to a respective divider flap at a lateral fold line 59, 61. The first divider flap 47 is at least partially defined by an upper cut 65, a lower cut 67, a lateral cut 69, and the lateral fold line 49. The second divider flap 51 is at least partially defined by an upper cut 73 that extends from a lateral edge of the blank 3 to the fold line 53, an upper edge 75, a lower edge 77 corresponding to a longitudinal edge of the blank, a lateral edge 79 corresponding to a lateral edge of the blank, and the lateral fold line 53.

The back portion 9 includes a back central panel 81 foldably connected to the second side panel 19*b* at a lateral fold line 43*b*. The central panel 81 includes a handle opening 45*b*. A first divider flap 87 is foldably connected to the back central panel 81 at a lateral fold line 89. A second divider flap 91 is foldably connected to the back central panel 81 at a lateral fold line 93. Each divider flap 87, 91 includes a respective adhesive flap 95, 97 foldably connected to a respective divider flap at a lateral fold line 99, 101. The first divider flap 87 is at least partially defined by an upper cut 105, a lower cut 107, a lateral cut 109, and the lateral fold line 89. The second divider flap 91 is at least partially defined by an upper cut 113 that extend from a lateral edge of the blank 3 to the fold line 93, an upper edge 115, a lower edge 117 corresponding to a longitudinal edge of the blank, a lateral edge 119 corresponding to a lateral edge of the blank, and the lateral fold line 93.

In the illustrated embodiment, the blank 3 includes a longitudinal fold line 125 that foldably connects the front central panel 41 and the back central panel 81. Also, a longitudinal fold line 127 foldably connects the front handle panel 21*a* and the back handle panel 21*b*. A longitudinal fold line 129 foldably connects the front central panel flap 27*a* and the back central panel flap 27*b*. In the illustrated embodiment, the longitudinal fold lines 125, 127, 129 are aligned with the longitudinal centerline CL of the blank 3.

Figure 4:
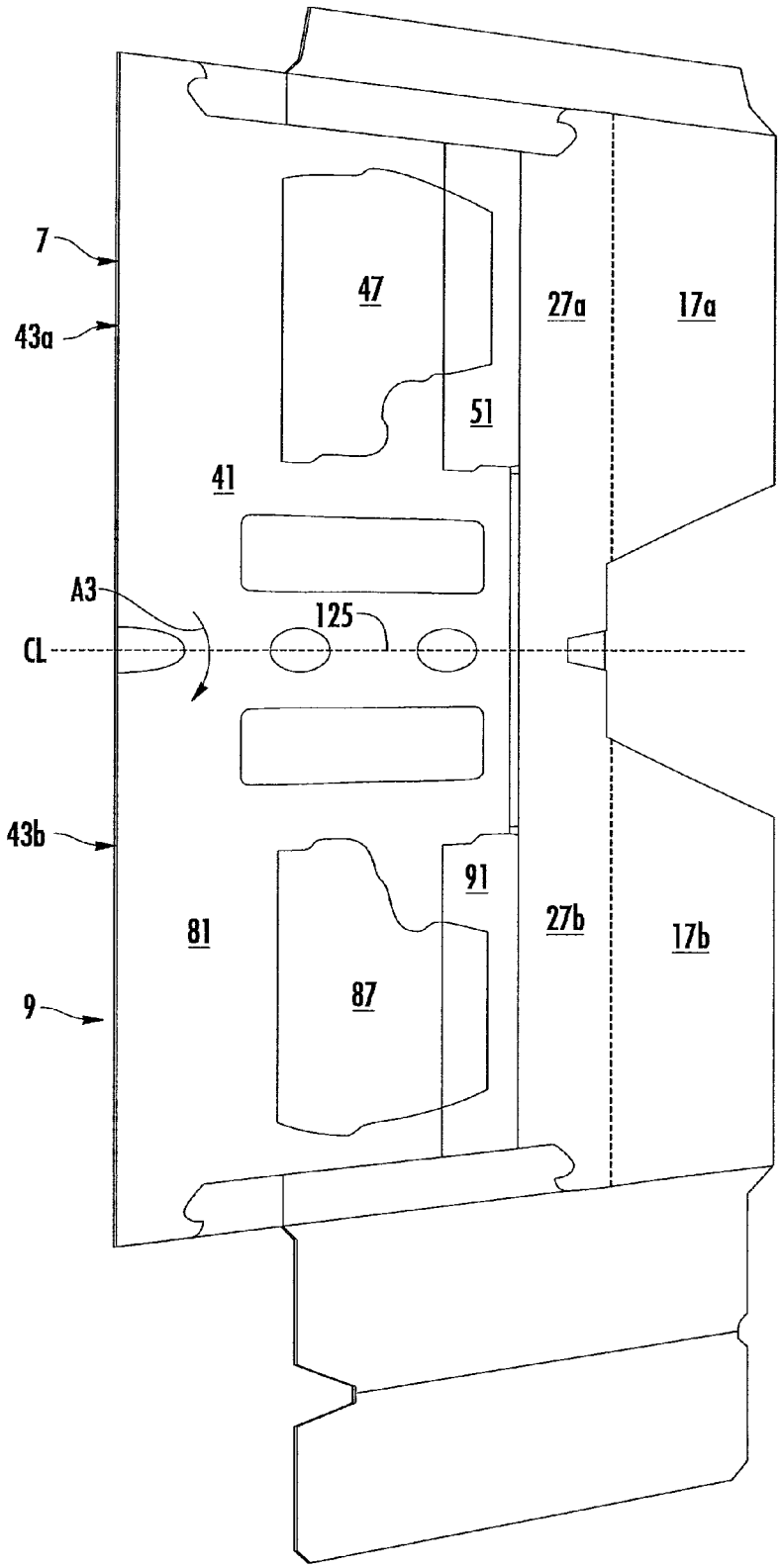
Figure 4A:
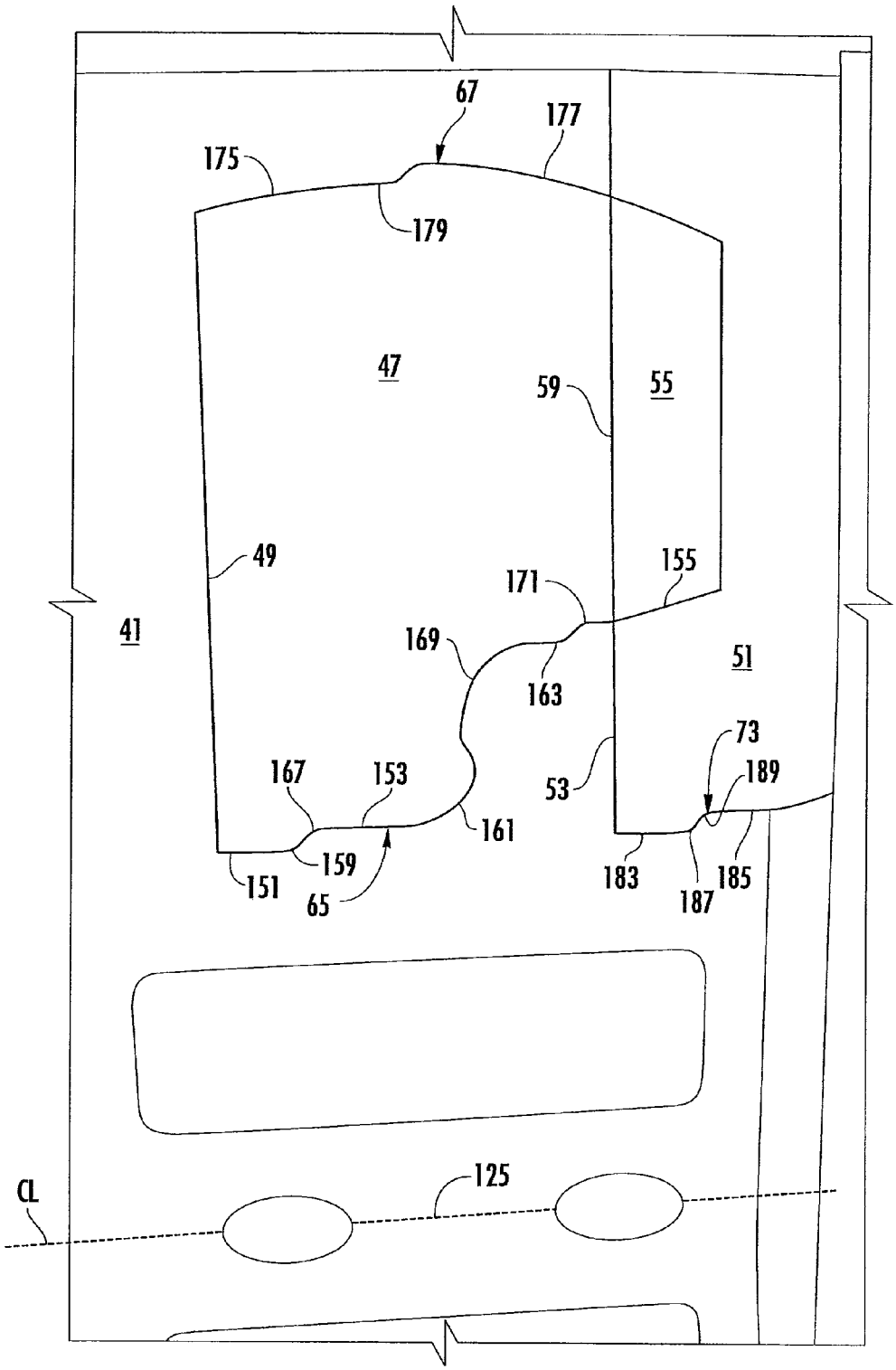
FIGS. 4A and 4B are detail views of divider flaps according to one embodiment of the disclosure.
Figure 10:
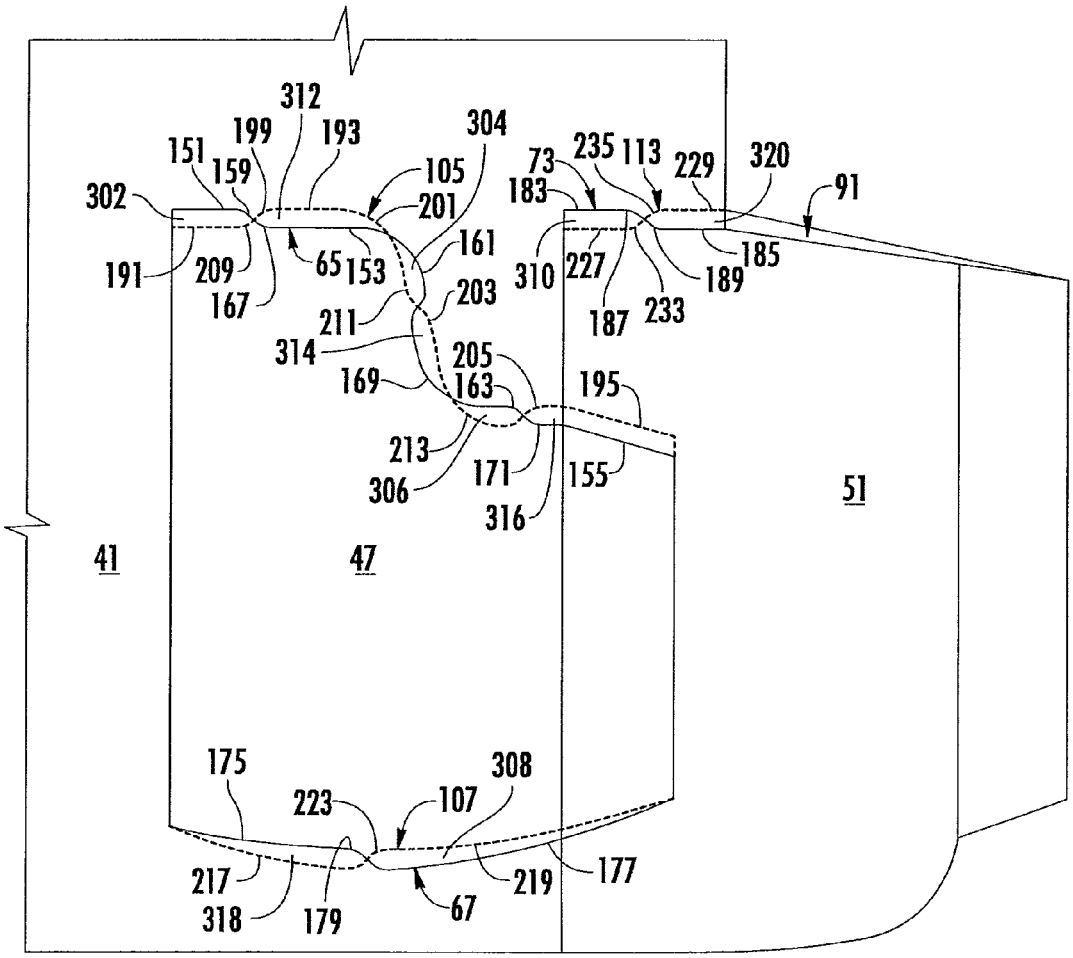
FIG. 10 is a detail view of divider flaps of a front central panel showing edges of a back central panel in phantom according to one embodiment of the disclosure.

As shown in FIGS. 4A, and 10, the top cut 65 is generally serpentine in shape having generally straight portions forming respective edge portions 151, 153, 155 of the front central panel 41, curved portions forming respective concave edge portions or shoulders 159, 161, 163 of the front central panel 41, and curved portions forming respective convex edge portions or shoulders 167, 169, 171 of the front central panel. The bottom cut 67 has curved portions forming respective concave edge portions 175, 177 of the front central panel 41 and a curved portion forming a convex edge portion 179 of the front central panel. The upper cut 73 has two generally straight portions forming edge portions 183, 185 of the front central panel 41, a curved portion forming a concave edge portion 187 of the front central panel 41, and a curved portion forming a convex edge portion 189 of the front central panel.

Figure 4B:
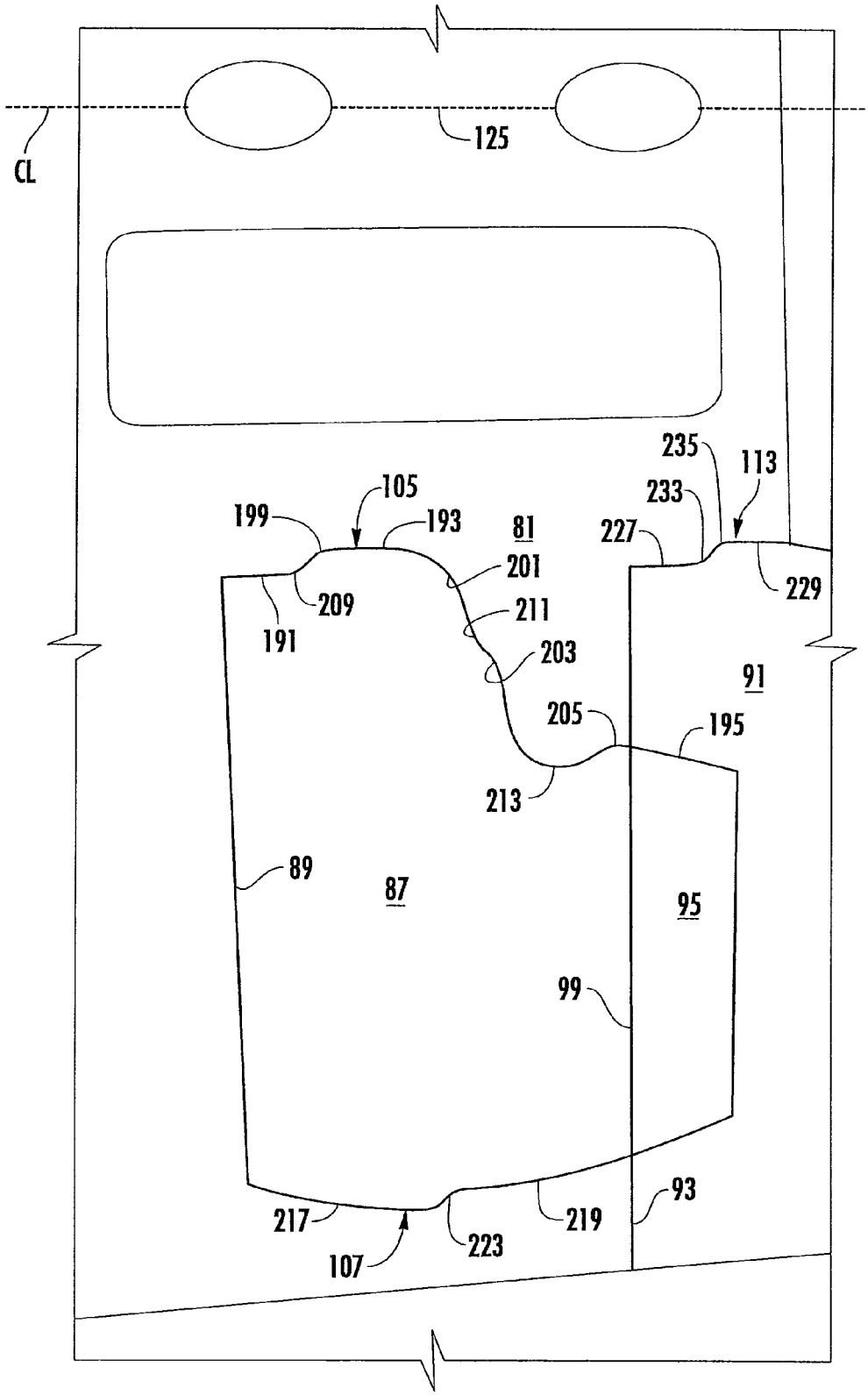
Figure 5:
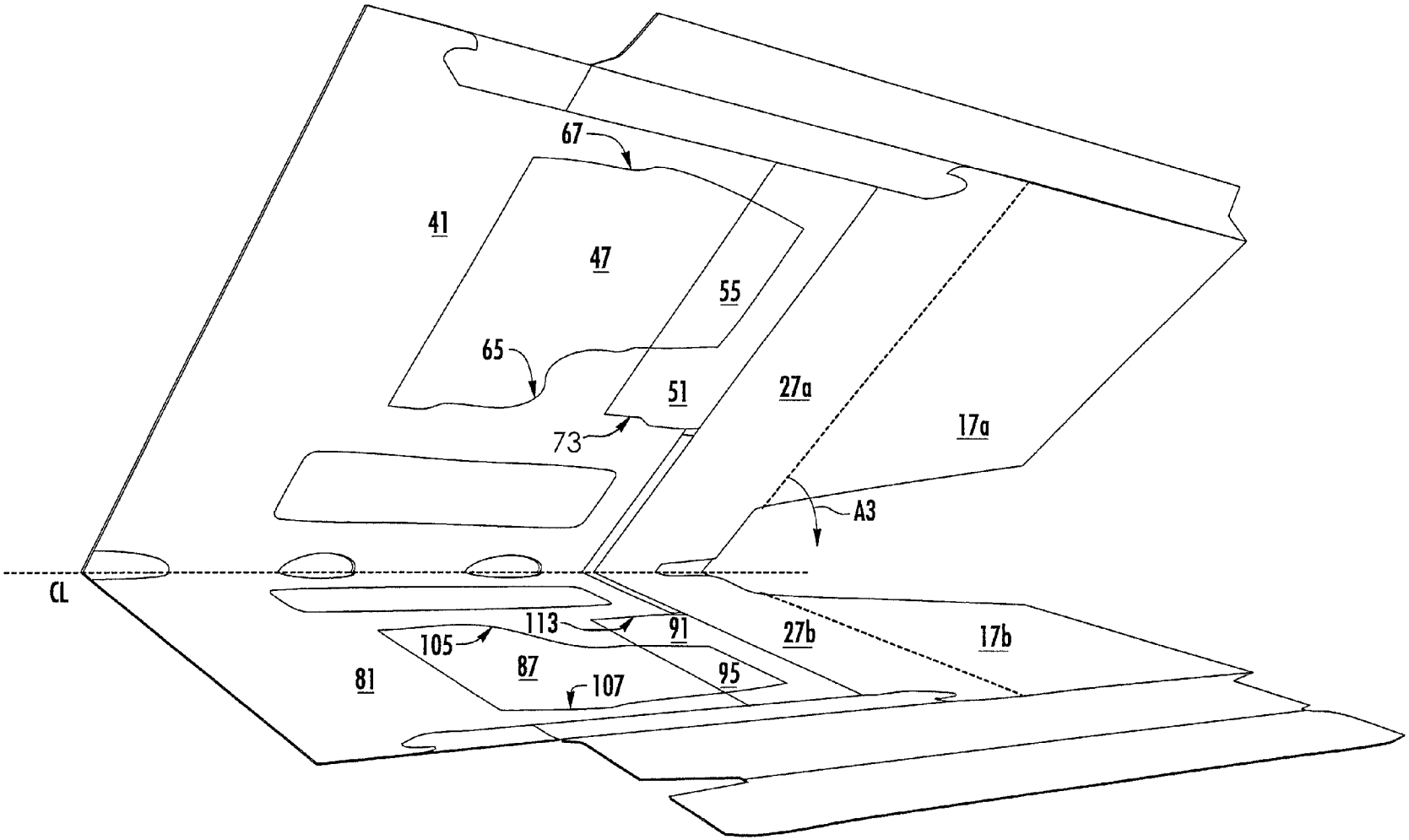
FIGS. 5 and 6 are views showing further folding of the partially-erected carrier of FIG. 4 into the carrier according to one embodiment of the disclosure.
Figure 6:
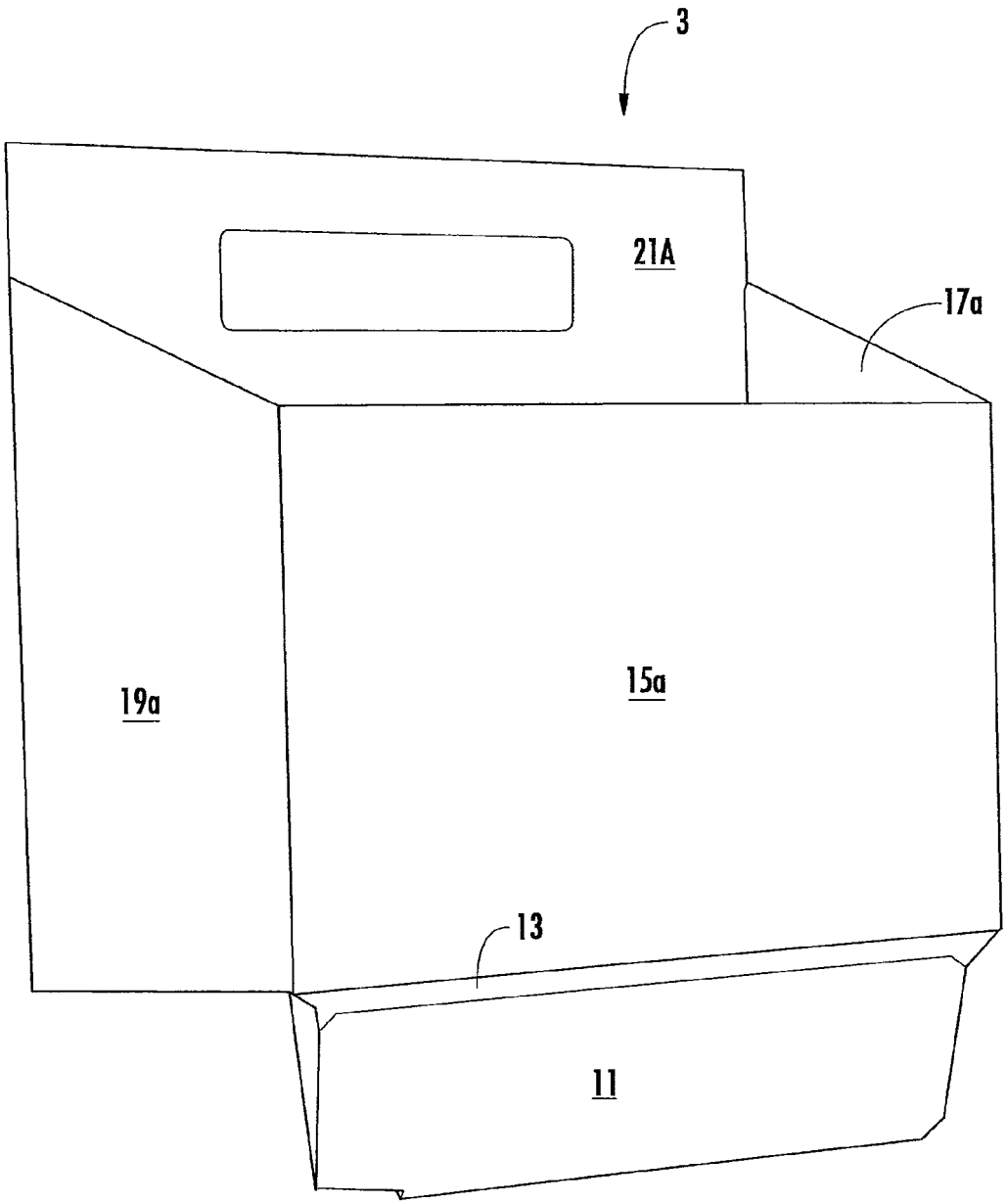

As shown in FIGS. 4B, and 10, the top cut 105 is generally serpentine in shape having generally straight portions forming respective edge portions 191, 193, 195, of the back central panel 81, curved portions forming respective concave edge portions or shoulders 199, 201, 203, 205 of the back central panel 81, and curved portions forming respective convex edge portions or shoulders 209, 211, 213 of the back central panel. The bottom cut 107 has curved portions forming respective concave edge portions 217, 219 of the back central panel 81 and a curved portion forming a convex edge portion 223 of the back central panel. The upper cut 113 has two generally straight portions forming edge portions 227, 229 of the back central panel 81, a curved portion forming a convex edge portion 233 of the back central panel 81, and a curved portion forming a concave edge portion 235 of the back central panel.

In the illustrated embodiment, the shape of the top cuts 65, 105, the shape of the bottom cuts 67, 107 and the shape of the cuts 73, 113 form features of the blank 3 that facilitate forming of the carrier 5 from the blank. These features can include portions of the back central panel 81 that form tabs that protrude from the edges of the front central panel 41 and portions of the front central panel 41 that form tabs that protrude from the edges of the back central panel 81. Particularly, as illustrated in FIGS. 8 and 10, a protruding tab 302 is formed between edge portions 151, 159 of the cut 65 and edge portions 191, 209 of the cut 105, a protruding tab 304 is formed between edge portions 161 and 211 of the respective cuts 65, 105, a protruding tab 306 is formed between edge portions 163 and 213 of the respective cuts 65, 105, a protruding tab 308 is formed between edges 177 and 219, 223 of the respective cuts 67, 107, and a protruding tab 310 is formed between edge portions 183, 187 and 227, 233 of the respective cuts 73, 113.

Further, as illustrated in FIGS. 9 and 10, a protruding tab 312 is formed between edge portions 193, 199, 201 of the cut 105 and edge portions 153, 167 of the cut 65, a protruding tab 314 is formed between edge portions 203 and 169 of the respective cuts 105, 65, a protruding tab 316 is formed between edge portions 205 and 171 of the respective cuts 105, 65, a protruding tab 318 is formed between edges 217 and 175, 179 of the respective cuts 107, 67, and a protruding tab 320 is formed between edge portions 229, 235 and 185, 189 of the respective cuts 113, 73.

Any of the panels, flaps, fold lines, cuts, or other features could be otherwise shaped, arranged, and/or omitted from the blank 3 without departing from the disclosure. The blank 3 could be sized and/or shaped to accommodate more or less than six containers without departing from this disclosure.

Figure 2:
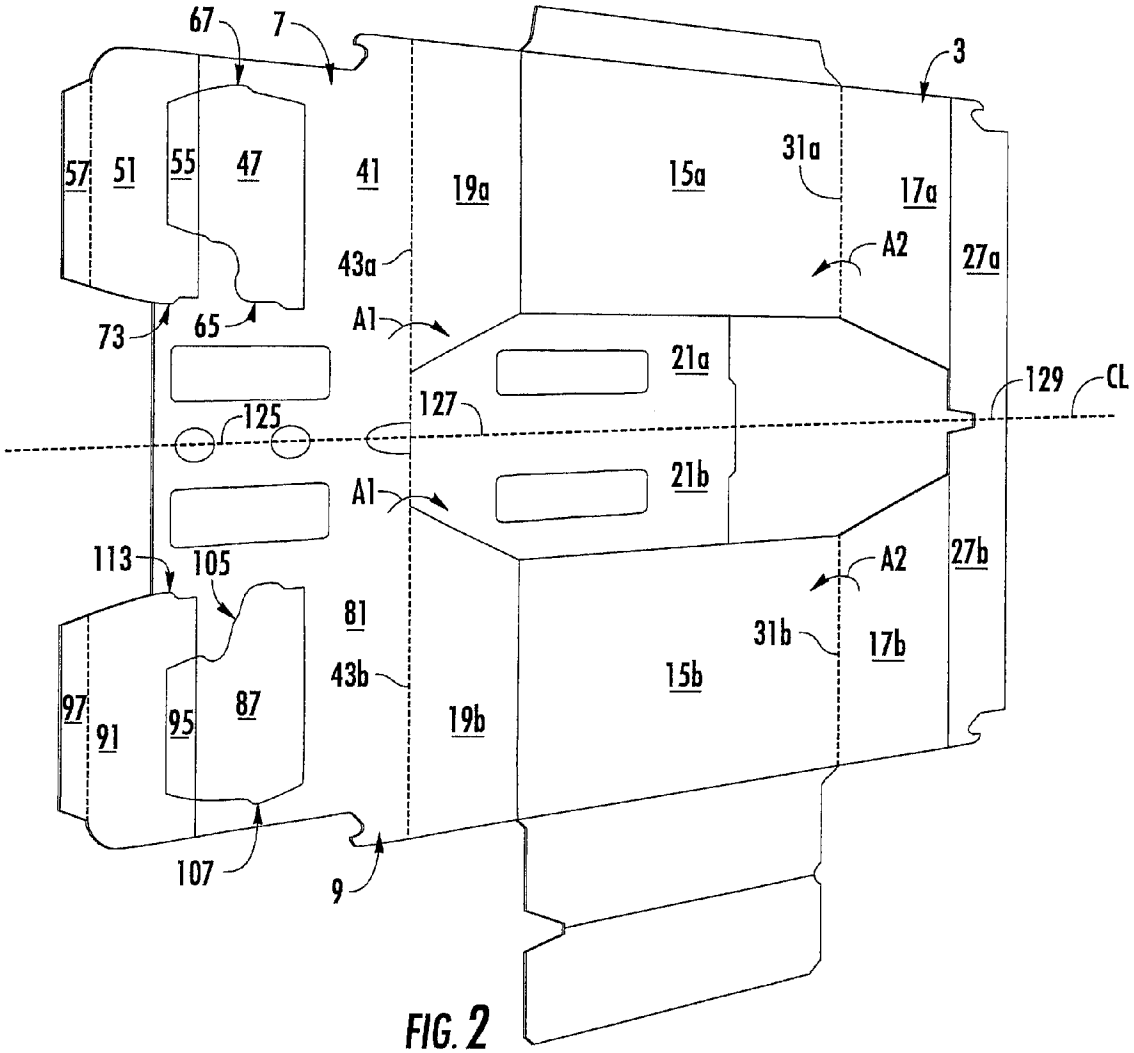
FIG. 2 is a perspective view of an interior of the carton blank of FIG. 1.
Figure 3:
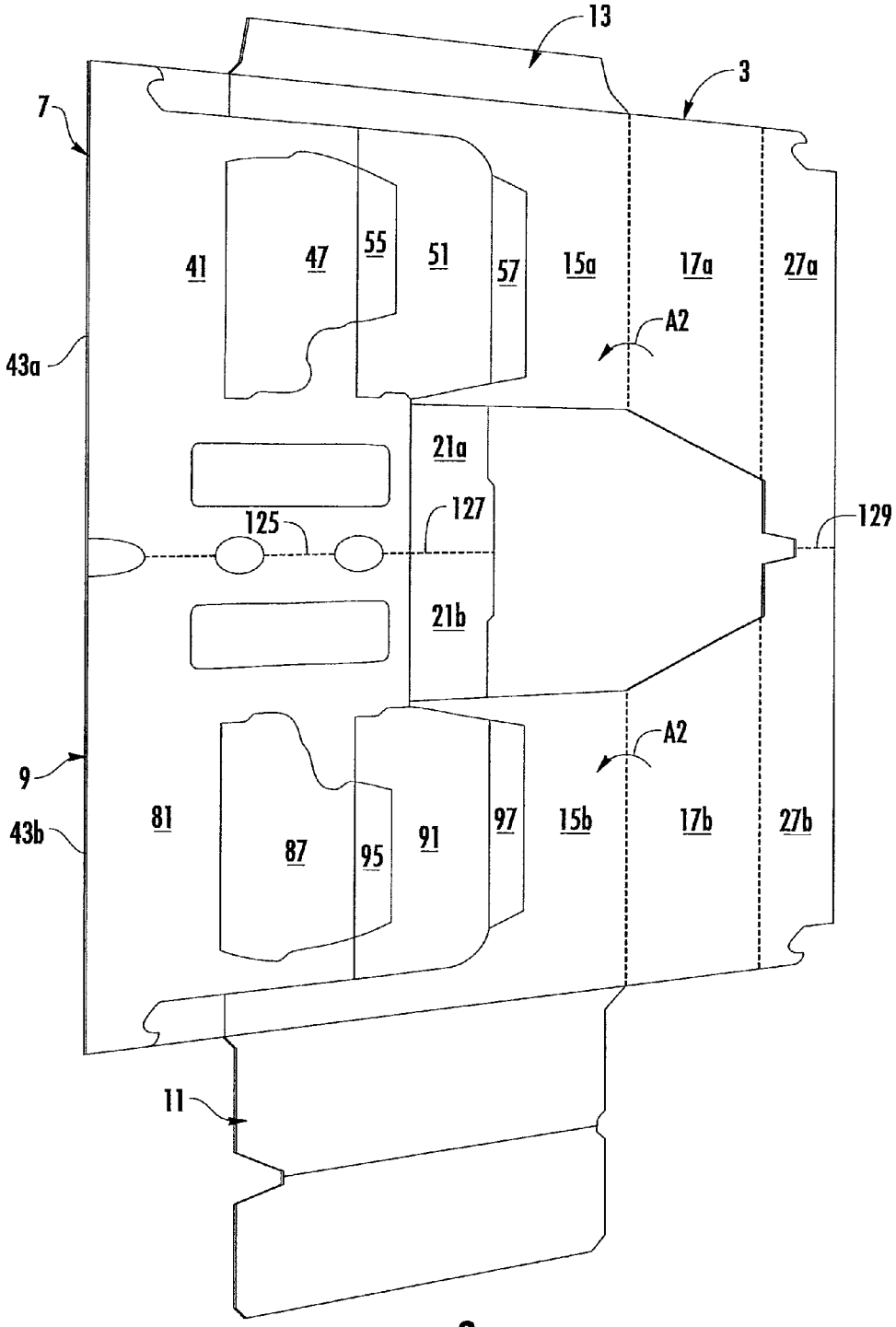
FIGS. 3 and 4 are views showing the folding of the carton blank to form a partially-erected carrier according to one embodiment of the disclosure.

With reference to FIGS. 2-7, in one exemplary method of erection, the blank 3 is positioned with its exterior surface 1 facing down, as illustrated in FIG. 2. The carrier 5 may be erected from the blank 3 by respectively folding the central panels 41, 81 in the direction of arrows A1 about fold lines 43*a*, 43*b* so that the central panels are in face-to-face relationship with portions of the handle panels 21*a*, 21*b* and the front and back panels 15*a*, 15*b*, as illustrated in FIG. 3. Glue or other adhesive is selectively applied to the blank 3 to adhesively connect the adhesive flaps 55, 57 to the front panel 15*a* with glue and to adhesively connect the adhesive flaps 95, 97 to the back panel 15*b*. Next, the first side panels 17*a*, 17*b* are folded in the direction of arrows A2 about fold lines 31*a*, 31*b* so that the first side panels and central panel flaps 27*a*, 27*b* are in face-to-face contact with portions of the front and back panels 15*a*, 15*b*, as illustrated in FIG. 4. Also, portions of the central panels 27*a*, 27*b* are in face-to-face contact with portions of the handle panels 21*a*, 21*b* and the central panels can be selectively adhesively secured thereto with glue.

Next, the partially assembled blank 3 is folded in the direction of arrow A3 (FIGS. 4 and 5) about the longitudinal centerline CL so that the front portion 7 overlaps the back portion 9. The bottom panel 11 is attached to the bottom panel adhesive flap 13 by glue, so that the partially assembled blank 3 has the configuration shown in FIG. 6. As shown in FIG. 7, the blank 3 is further assembled into the carrier by positioning the first side panels 17*a*, 17*b* and second side panels 19*a*, 19*b* to be in a generally spaced-apart, parallel planar relationship and positioning the front panel 15*a* and back panel 15*b* to be in a generally spaced-apart, parallel planar relationship. Such movement of the side panels 17*a*, 17*b*, 19*a*, 19*b* and front and back panels 15*a*, 15*b*, causes the divider flaps 47, 51 in the front portion of the carrier 5 to be positioned generally perpendicular to the central panel 41 and the front panel 15*a* to divide the front portion into three container-receiving spaces 255. Similarly, the back portion of the carrier is divided into three container receiving spaces 257 by the divider flaps 87, 91.

Containers can be placed into the spaces 255, 257 of the carrier 5. The bottoms of the containers are supported by the bottom wall 11 of the carrier 5.

In one exemplary embodiment, as shown in FIGS. 8 and 10, the features that facilitate movement of the divider flaps 47, 51 include the edge portions 191, 209, 211, 213, 219, 223, 227, 233 that form protruding tabs 302, 304, 306, 308, 310 of the central panel 81 of the back portion of the carrier 5 that protrude from the edges of the central panel 41 of the front portion, the edge of the central panel 41 being formed by the respective cuts 65, 67, 73. As shown in FIGS. 9 and 10, the features that facilitate movement of the divider flaps 87, 91 include edge portions 153, 167, 169, 171, 175, 179, 185, 189 that form protruding tabs 312, 314, 316, 318, 320 of the central panel 41 of the front portion of the carrier 5 that protrude from the edge of the central panel 81 of the back portion, the edge of the central panel 81 being formed by the respective cuts 105, 107, 113.

The protruding tabs 302, 304, 306, 308, 310, 312, 314, 316, 318, 320 serve as a stopper that prevent a respective divider flap 47, 51, 87, 91 from being folded inward past the respective central panel 41, 81 so that the edges of the divider flaps remain free from interlocking engagement with a corresponding edge of the central panel.

The exemplary carrier embodiment discussed above accommodates six containers arranged in two rows, but the present disclosure is not limited to these numbers. As one example, additional containers may be accommodated by increasing the size of the blank 3 (e.g., in the longitudinal direction L1 in FIG. 1) and forming additional container-receiving spaces therein. Also, the blank 3 could have less than six container-receiving spaces.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a plurality of panels that extends at least partially around an interior of the carrier, the panels comprising at least one bottom panel, a front panel, a back panel, and at least two side panels;

a first central panel;

a second central panel, the first and second central panels dividing the interior of the carrier into a front portion and a back portion;

a first divider flap foldably attached to the first central panel and extending to the front panel to divide the front portion into at least two front container-receiving spaces, wherein the first central panel comprises a first serpentine edge formed from a first top cut between the first central panel and the first divider flap prior to forming the carrier; and a second divider flap foldably attached to the second central panel and extending to the back panel to divide the back portion into at least two back container-receiving spaces, wherein the second central panel comprises a second serpentine edge formed from a second top cut between the second central panel and the second divider flap prior to forming the carrier;

wherein the first central panel has features for facilitating positioning of the second divider flap relative to the second central panel, and the second central panel has features for facilitating positioning of the first divider flap relative to the first central panel; and wherein the first and second serpentine edges comprise complementary serpentine shapes, at least a portion of the first and second serpentine edges overlap, and a portion of the second central panel protrudes from the first serpentine edge.

2. The carrier of claim 1, wherein a portion of the first central panel protrudes from the second serpentine edge.

3. The carrier of claim 1, wherein each of the first and second serpentine edges comprises a plurality of generally straight portions, a plurality of concave portions, and a plurality of convex portions.

4. The carrier of claim 1, wherein the first serpentine edge extends between a first lateral fold line connecting the first divider flap to the first central panel and a first lateral edge of the first central panel formed from a first lateral cut between the first divider flap and the first central panel prior to forming the carrier, and wherein the first serpentine edge comprises a first generally straight portion extending from the first lateral fold line, a first concave portion extending from the first straight portion, a first convex portion extending from the first concave portion, a second generally straight portion extending from the first convex portion, a second concave portion extending from the second straight portion, a second convex portion extending from the second concave portion, a third concave portion extending from the second convex portion, a third convex portion extending from the third concave portion, and a third generally straight portion extending from the third convex portion.

5. The carrier of claim 4, wherein the second serpentine edge extends between a second lateral fold line connecting the second divider flap to the second central panel and a second lateral edge of the second central panel formed from a second lateral cut between the second divider flap and the second central panel prior to forming the carrier, and wherein the second serpentine edge comprises a first generally straight portion extending from the second lateral fold line, a first convex portion extending from the first straight portion, a first concave portion extending from the first convex portion, a second generally straight portion extending from the first concave portion, a second concave portion extending from the second straight portion, a second convex portion extending from the second concave portion, a third concave portion extending from the second convex portion, a third convex portion extending from the third concave portion, a fourth concave portion extending from the third convex portion, and a third generally straight portion extending from the fourth concave portion.

6. The carrier of claim 5, wherein a first portion of the second central panel protrudes from the first serpentine edge between at least a portion of the first straight portion and first concave portion of the first serpentine edge and at least a portion of the first straight portion and first convex portion of the second serpentine edge, a second portion of the central panel protrudes from the first serpentine edge between at least a portion of the second concave portion of the first serpentine edge and at least a portion of the second convex portion of the second serpentine edge, and a third portion of the central panel protrudes from the first serpentine edge between at least a portion of the third concave portion of the first serpentine edge and at least a portion of the third convex portion of the second serpentine edge.

7. The carrier of claim 1, further comprising a front handle panel foldably attached to and at least partially in face-to-face contact with the first central panel and a back handle panel foldably attached to at least partially in face-to-face contact with the second central panel, wherein the front and back handle panels and the first and second central panels comprise features for forming a handle opening in the carrier.

8. A carrier for holding a plurality of containers, the carrier comprising:

a plurality of panels that extends at least partially around an interior of the carrier, the panels comprising at least one bottom panel, a front panel, a back panel, and at least two side panels;

a first central panel;

a second central panel, the first and second central panels dividing the interior of the carrier into a front portion and a back portion;

a first divider flap foldably attached to the first central panel and extending to the front panel to divide the front portion into at least two front container-receiving spaces, wherein the first central panel comprises a first serpentine edge formed from a first top cut between the first central panel and the first divider flap prior to forming the carrier; and a second divider flap foldably attached to the second central panel and extending to the back panel to divide the back portion into at least two back container-receiving spaces, wherein the second central panel comprises a second serpentine edge formed from a second top cut between the second central panel and the second divider flap prior to forming the carrier;

wherein the first central panel has features for facilitating positioning of the second divider flap relative to the second central panel, and the second central panel has features for facilitating positioning of the first divider flap relative to the first central panel;

wherein each of the first and second serpentine edges comprises a plurality of generally straight portions, a plurality of concave portions, and a plurality of convex portions; and wherein portions of the first serpentine edge overlap with portions of the second serpentine edge, and portions of the second central panel protrude from the first serpentine edge between at least a portion of each concave portion of the first serpentine edge and at least a portion of a respectively adjacent convex portion of the second serpentine edge.

9. The carrier of claim 8, wherein the first central panel further comprises a first lower serpentine edge formed from a first bottom cut between the first central panel and the first divider flap prior to forming the carrier, and wherein the second central panel further comprises a second lower serpentine edge formed from a second bottom cut between the second central panel and the second divider flap prior to forming the carrier.

10. The carrier of claim 9, wherein each of the first and second lower serpentine edges comprises at least one concave portion and at least one convex portion, and wherein at least a portion of the first lower serpentine edge overlaps with at least a portion of the second lower serpentine edge, and a portion of the second central panel protrudes from the first lower serpentine edge between at least a portion of the at least one concave portion of the first lower serpentine edge and at least a portion of the at least one convex portion of the second lower serpentine edge.

11. The carrier of claim 8, further comprising a third divider flap foldably attached to the first central panel and extending to the front panel, and a fourth divider flap foldably attached to the second central panel and extending to the back panel, wherein the first central panel comprises a third serpentine edge formed from a third top cut between the first central panel and the third divider flap prior to forming the carrier and the second central panel comprises a fourth serpentine edge formed from a fourth top cut between the second central panel and the fourth divider flap prior to forming the carrier.

12. The carrier of claim 11, wherein the third and fourth serpentine edges comprise complementary serpentine edges that each comprises at least one generally straight portion, at least one concave portion, and at least one convex portion, and wherein at least a portion of the third serpentine edge overlaps with at least a portion of the fourth serpentine edge, and at least one portion of the second central panel protrudes from the third serpentine edge.

13. A blank for forming a carrier, the blank comprising:

a plurality of panels comprising at least one bottom panel, a front panel, a back panel, and at least two side panels;

a first central panel;

a second central panel, the first and second central panels being for dividing an interior of the carrier formed from the blank into a front portion and a back portion;

a first divider flap foldably attached to the first central panel, wherein the first central panel comprises a first serpentine edge formed from a first top cut between the first central panel and the first divider flap; and a second divider flap foldably attached to the second central panel, wherein the second central panel comprises a second serpentine edge formed from a second top cut between the second central panel and the second divider flap;

wherein the first central panel has features for facilitating positioning of the second divider flap relative to the second central panel, and the second central panel has features for facilitating positioning of the first divider flap relative to the first central panel; and wherein the first and second serpentine edges comprise complementary serpentine shapes, at least a portion of the first and second serpentine edges overlap, and a portion of the second central panel protrudes from the first serpentine edge when the carrier is formed from the blank with the first central panel at least partially in face-to-face contact with the second central panel.

14. The blank of claim 13, wherein a portion of the first central panel protrudes from the second serpentine edge when the carrier is formed from the blank with the first central panel at least partially in face-to-face contact with the second central panel.

15. The blank of claim 13, wherein each of the first and second serpentine edges comprises a plurality of generally straight portions, a plurality of concave portions, and a plurality of convex portions.

16. The blank of claim 13, further comprising a front handle panel foldably attached to the first central panel and a back handle panel foldably attached to the second central panel, wherein the front and back handle panels and the first and second central panels comprise features for forming a handle opening in the carrier formed from the blank.

17. A blank for forming a carrier, the blank comprising:

a plurality of panels comprising at least one bottom panel, a front panel, a back panel, and at least two side panels;

a first central panel;

a second central panel, the first and second central panels being for dividing an interior of the carrier formed from the blank into a front portion and a back portion;

a first divider flap foldably attached to the first central panel, wherein the first central panel comprises a first serpentine edge formed from a first top cut between the first central panel and the first divider flap; and a second divider flap foldably attached to the second central panel, wherein the second central panel comprises a second serpentine edge formed from a second top cut between the second central panel and the second divider flap;

wherein the first central panel has features for facilitating positioning of the second divider flap relative to the second central panel, and the second central panel has features for facilitating positioning of the first divider flap relative to the first central panel;

wherein each of the first and second serpentine edges comprises a plurality of generally straight portions, a plurality of concave portions, and a plurality of convex portions; and wherein when the carrier is formed from the blank with the first central panel at least partially in face-to-face contact with the second central panel, portions of the first serpentine edge overlap with portions of the second serpentine edge, and portions of the second central panel protrude from the first serpentine edge between at least a portion of each concave portion of the first serpentine edge and at least a portion of a respectively adjacent convex portion of the second serpentine edge.

18. The blank of claim 17, wherein the first central panel further comprises a first lower serpentine edge formed from a first bottom cut between the first central panel and the first divider flap, and wherein the second central panel further comprises a second lower serpentine edge formed from a second bottom cut between the second central panel and the second divider flap.

19. The blank of claim 18, wherein each of the first and second lower serpentine edges comprises at least one concave portion and at least one convex portion, and wherein at least a portion of the first lower serpentine edge overlaps with at least a portion of the second lower serpentine edge, and a portion of the second central panel protrudes from the first lower serpentine edge between at least a portion of the at least one concave portion of the first lower serpentine edge and at least a portion of the at least one convex portion of the second lower serpentine edge when the carrier is formed from the blank with the first central panel at least partially in face-to-face contact with the second central panel.

20. The blank of claim 17, further comprising a third divider flap foldably attached to the first central panel, and a fourth divider flap foldably attached to the second central panel, wherein the first central panel comprises a third serpentine edge formed from a third top cut between the first central panel and the third divider flap and the second central panel comprises a fourth serpentine edge formed from a fourth top cut between the second central panel and the fourth divider flap.

21. The blank of claim 20, wherein the third and fourth serpentine edges comprise complementary serpentine edges that each comprises at least one generally straight portion, at least one concave portion, and at least one convex portion, and wherein at least a portion of the third serpentine edge overlaps with at least a portion of the fourth serpentine edge, and at least one portion of the second central panel protrudes from the third serpentine edge when the carrier is formed from the blank with the first central panel at least partially in face-to-face contact with the second central panel.

22. A method of forming a carrier from a blank, the method comprising:

obtaining a blank comprising a plurality of panels comprising at least one bottom panel, a front panel, a back panel, and at least two side panels, a first central panel, a second central panel, a first divider flap foldably attached to the first central panel, a second divider flap foldably attached to the second central panel, wherein the first central panel comprises a first top cut between the first central panel and the first divider flap, and the second central panel comprises a second top cut between the second central panel and the second divider flap, and wherein the first central panel has features for facilitating positioning of the second divider flap relative to the second central panel, and the second central panel has features for facilitating positioning of the first divider flap relative to the first central panel;

folding the first and second central panels to be at least partially in face-to-face contact with at least a portion of the respective front and back panels;

folding the blank along a longitudinal centerline so that the first central panel is at least partially in face-to-face contact with the second central panel;

forming an interior of the carrier by extending the at least two side panels away from the respective first and second central panels so that the interior of the carrier is divided into a front portion and a back portion by the first and second central panels; and pivoting each of the first and second divider flaps away from the respective first and second central panels so that each of the first and second divider flaps extends to a respective one of the front and back panels, the pivoting the first divider flap forming a first serpentine edge at the first top cut, and the pivoting the second divider flap forming a second serpentine edge at the second top cut;

wherein the first and second serpentine edges comprise complementary serpentine shapes, at least a portion of the first and second serpentine edges overlap after the folding the blank along the longitudinal centerline, and a portion of the second central panel protrudes from the first serpentine edge after the pivoting each of the first and second divider flaps.

23. The method of claim 22, wherein a portion of the first central panel protrudes from the second serpentine edge after the pivoting each of the first and second divider flaps.

24. The method of claim 22, wherein each of the first and second serpentine edges comprises a plurality of generally straight portions, a plurality of concave portions, and a plurality of convex portions.

25. The method of claim 22, wherein the blank further comprises a front handle panel foldably attached to the first central panel and a back handle panel foldably attached to the second central panel, and the method further comprises forming a handle opening in the front and back handle panels and the first and second central panels.

26. The method of claim 22, further comprising attaching the first divider flap and the second divider flap to the respective front panel and back panel with an adhesive.

27. A method of forming a carrier from a blank, the method comprising:

obtaining a blank comprising a plurality of panels comprising at least one bottom panel, a front panel, a back panel, and at least two side panels, a first central panel, a second central panel, a first divider flap foldably attached to the first central panel, a second divider flap foldably attached to the second central panel, wherein the first central panel comprises a first top cut between the first central panel and the first divider flap, and the second central panel comprises a second top cut between the second central panel and the second divider flap, and wherein the first central panel has features for facilitating positioning of the second divider flap relative to the second central panel, and the second central panel has features for facilitating positioning of the first divider flap relative to the first central panel;

folding the first and second central panels to be at least partially in face-to-face contact with at least a portion of the respective front and back panels;

folding the blank along a longitudinal centerline so that the first central panel is at least partially in face-to-face contact with the second central panel;

forming an interior of the carrier by extending the at least two side panels away from the respective first and second central panels so that the interior of the carrier is divided into a front portion and a back portion by the first and second central panels; and pivoting each of the first and second divider flaps away from the respective first and second central panels so that each of the first and second divider flaps extends to a respective one of the front and back panels, the pivoting the first divider flap forming a first serpentine edge at the first top cut, and the pivoting the second divider flap forming a second serpentine edge at the second top cut;

wherein each of the first and second serpentine edges comprises a plurality of generally straight portions, a plurality of concave portions, and a plurality of convex portions; and wherein portions of the first serpentine edge overlap with portions of the second serpentine edge after the folding the blank along the longitudinal centerline, and portions of the second central panel protrude from the first serpentine edge between at least a portion of each concave portion of the first serpentine edge and at least a portion of a respectively adjacent convex portion of the second serpentine edge after the pivoting each of the first and second divider flaps.

28. The method of claim 27, wherein the first central panel further comprises a first lower serpentine edge formed from a first bottom cut between the first central panel and the first divider flap prior to the pivoting each of the first and second divider flaps, and wherein the second central panel further comprises a second lower serpentine edge formed from a second bottom cut between the second central panel and the second divider flap prior to the pivoting each of the first and second divider flaps.

29. The method of claim 28, wherein each of the first and second lower serpentine edges comprises at least one concave portion and at least one convex portion, and wherein at least a portion of the first lower serpentine edge overlaps with at least a portion of the second lower serpentine edge after the folding the blank along the longitudinal centerline, and a portion of the second central panel protrudes from the first lower serpentine edge between at least a portion of the at least one concave portion of the first lower serpentine edge and at least a portion of the at least one convex portion of the second lower serpentine edge after the pivoting each of the first and second divider flaps.

30. The method of claim 27, wherein the blank further comprises a third divider flap foldably attached to the first central panel and a fourth divider flap foldably attached to the second central panel, wherein the first central panel comprises a third serpentine edge formed from a third top cut between the first central panel and the third divider flap prior to the pivoting each of the first and second divider flaps and the second central panel comprises a fourth serpentine edge formed from a fourth top cut between the second central panel and the fourth divider flap prior to the pivoting each of the first and second divider flaps.

31. The method of claim 30, further comprising pivoting each of the third and fourth divider flaps away from the respective first and second central panels so that each of the third and fourth divider flaps extends to a respective one of the front and back panels.

32. The method of claim 30, wherein the third and fourth serpentine edges comprise complementary serpentine edges that each comprises at least one generally straight portion, at least one concave portion, and at least one convex portion, and wherein at least a portion of the third serpentine edge overlaps with at least a portion of the fourth serpentine edge after the folding the blank along the longitudinal centerline, and at least one portion of the second central panel protrudes from the third serpentine edge after the pivoting each of the first and second divider flaps.

* * * * *